US007931755B2

(12) United States Patent
Nishio et al.

(10) Patent No.: US 7,931,755 B2
(45) Date of Patent: Apr. 26, 2011

(54) METHOD FOR REMOVING DEPOSIT FROM SUBSTRATE AND METHOD FOR DRYING SUBSTRATE, AS WELL AS APPARATUS FOR REMOVING DEPOSIT FROM SUBSTRATE AND APPARATUS FOR DRYING SUBSTRATE USING THESE METHODS

(75) Inventors: Yoshitaka Nishio, Osaka (JP); Yukio Oshima, Osaka (JP)

(73) Assignee: Mitsuboshi Diamond Industrial Co., Ltd, Osaka (JP)

( * ) Notice: Subject to any disclaimer, the term of this patent is extended or adjusted under 35 U.S.C. 154(b) by 1054 days.

(21) Appl. No.: 10/583,348

(22) PCT Filed: Dec. 16, 2004

(86) PCT No.: PCT/JP2004/018817

§ 371 (c)(1),
(2), (4) Date: Apr. 5, 2007

(87) PCT Pub. No.: WO2005/059984

PCT Pub. Date: Jun. 30, 2005

(65) Prior Publication Data

US 2007/0281094 A1 Dec. 6, 2007

(30) Foreign Application Priority Data

Dec. 19, 2003 (JP) ..... 2003-436719

(51) Int. Cl.
*B08B 5/00* (2006.01)
*B08B 5/02* (2006.01)

(52) U.S. Cl. ..... 134/37; 134/36; 15/300.1; 34/487

(58) Field of Classification Search ..... 134/37; 34/369; 15/300.1
See application file for complete search history.

(56) References Cited

U.S. PATENT DOCUMENTS 4,197,126 A * 4/1980 Wessells et al. ..... 430/306
(Continued)

FOREIGN PATENT DOCUMENTS

JP 09162147 A * 6/1997
JP 2000146443 A * 5/2000
(Continued)

*Primary Examiner* — Michael Barr
*Assistant Examiner* — Natasha Campbell
(74) *Attorney, Agent, or Firm* — Antonelli, Terry, Stout & Kraus, LLP.

(57) ABSTRACT

In a method for removing deposit that has attached to a main surface of a substrate from the main surface of the substrate using air knife units where a slit portion is formed so that a fluid can be discharged in band form, a fluid introduction path having an approximately uniform form in the direction perpendicular to the direction in which a number of air knife units move relative to the substrate is formed between the air knife units and the main surface of the substrate while the air knife units move relative to the substrate, a fluid is discharged toward the fluid introduction path from a slit that is formed in the rear portion of the above described air knife units, and then, passes through the fluid introduction path so as to be led to a wall surface that is formed so as to face the front portion of the air knife units or the fluid which has the appearance of a wall surface, and furthermore, deposit on the substrate that has attached to the substrate is led away from the main surface of the substrate, together with said fluid, via a fluid lead-out path of which the cross sectional area of the low path is greater than that of the fluid introduction path, and which is formed between the air knife units and the wall surface.

12 Claims, 13 Drawing Sheets

U.S. PATENT DOCUMENTS 4,477,287 A * 10/1984 Kush et al. ..... 134/15
2002/0148483 A1 * 10/2002 Mertens et al. ..... 134/1.3

FOREIGN PATENT DOCUMENTS

JP 2002-343761 11/2002

* cited by examiner

Background

Background

METHOD FOR REMOVING DEPOSIT FROM SUBSTRATE AND METHOD FOR DRYING SUBSTRATE, AS WELL AS APPARATUS FOR REMOVING DEPOSIT FROM SUBSTRATE AND APPARATUS FOR DRYING SUBSTRATE USING THESE METHODS

TECHNICAL FIELD

The present invention relates to a method for removing deposit from a substrate where deposit on a substrate that has attached to the front and rear surface of a substrate which has been processed in a previous step and a method for drying a substrate, as well as an apparatus for removing deposit from a substrate and an apparatus for drying a substrate using these methods. The present invention can be applied to metal substrates, non-metal substrates, such as plastic substrates, and brittle material substrates, such as glass substrates, semiconductor wafers and ceramic substrates.

BACKGROUND TECHNOLOGY

Glass substrates and semiconductor wafers are cleaned by a cleaning apparatus in manufacturing processes for, for example, liquid crystal displays and semiconductor devices. These substrates are cleaned in accordance with a technique such as brush cleaning using a cleaning liquid or ultrasonic cleaning, and after that, rinsed with pure water or the like (cleaning step), and then, the pure water for rinsing is removed from the front and rear surface of the substrate (drying step). In recent years, in the drying step, an air knife has been widely used. The air knife is usually formed in such a manner that steam or a gas is jetted in band form from a slit.

FIG. 13 is a plan diagram showing the apparatus for processing a substrate 900 of Patent Document 1.

In FIG. 13, a substrate 90 in a state of being wet with a processing liquid is discharged from a portion for processing a substrate 901, for example, a cleaning apparatus or a polishing processing apparatus, and is mounted on a roller conveyor 902 of apparatus for processing a substrate 900. The rollers of roller conveyor 902 rotate, and thereby, substrate 90 is conveyed in the direction of the arrow in the figure. A pair of air knives 903 for removing the liquid from the front and rear surfaces of substrate 90 so as to dry the substrate are provided above and below the substrate on the path of conveyance of substrate 90.

Air knives 903 are respectively installed in such a manner as to be inclined by approximately 30° relative to the direction perpendicular to the direction in which substrate 90 is conveyed by roller conveyor 902 in the plane where substrate are conveyed, have an opening in slit form for gas discharge which covers the area between the two ends of the substrate in the direction perpendicular to the direction in which substrate 90 is conveyed, and blows air in band form on substrate 90 which passes directly beneath or directly above the air knife, at a point that is at an appropriate distance from portion for processing a substrate 901.

In FIG. 13, when substrate 90 passes by air knives 903, the liquid on the front and rear surface of substrate 90 is swept to the downstream side in the direction in which substrate 90 is conveyed, and after that, the liquid on the front and rear surfaces of substrate 90 is swept so as to move from corner B to corner A on the downstream side in the direction in which substrate 90 is conveyed.

FIG. 14 is a cross sectional diagram showing the air knives for drying the front and rear surface of a substrate 90 which are disclosed in Patent Document 2. An upper air knife 910 which is placed on the upper surface of substrate 90 is provided with a gas jetting portion 911 for jetting, for example, compressed air, and a mist collecting portion 912, and a lower air knife 920 which is placed on the lower surface of substrate 90 is provided with a gas jetting portion 921 and a mist collecting portion 922 in the same manner as upper air knife 910.

A liquid adheres to the upper surface of substrate 90 in the state of a liquid film La, and a liquid adheres to the lower surface of substrate 90 in the state of innumerable liquid drops Lb. When substrate 90 is conveyed in the direction of the arrow in the figure so as to pass by air knife 910 and air knife 920, gas jetting portions 911 and 921 of the respective air knives 910 and 920 blow a gas, for example, compressed air, on the front and rear surface of substrate 90, respectively, in the diagonally downward and diagonally upward direction from jetting openings 913 and 923.

All of liquid film La on the upper surface of substrate 90 is blown on the side opposite to the direction in which substrate 90 is conveyed, and at the same time, mist is created above substrate 90, and this mist is sucked by mist collecting portion 912.

In addition, liquid drops Lb on the lower surface of substrate 90 are converted to mist, in the same manner as on the upper surface of substrate 90, and are sucked by mist collecting portion 922.

Patent Document 1: Japanese Unexamined Patent Publication 2001-284310

Patent Document 2: Japanese Unexamined Patent Publication 2003-229404

DISCLOSURE OF THE INVENTION

Problem to be Solved by the Invention

In a method and an apparatus for drying substrate 90 using air knives 903 which are described in the above described Patent Document 1, the liquid on the front and rear surface of substrate 90 is swept to the downstream side, in the direction in which the substrate is conveyed, that is to say, to the left in FIG. 13, and after that, swept so as to move from corner B to corner A along the rear portion of substrate 90, and then, attaches to end surface portion C on the rear portion of substrate 90. The liquid that has attached to end surface portion C cannot easily be removed, and therefore, it is difficult to sufficiently dry substrate 90.

In addition, in the method and an apparatus for drying substrate 90 using air knives 910 and 920 of Patent Document 2, when substrate 90 passes by air knives 910 and 920, some of the mist which rises from the surface of substrate 90 flies over to the upstream side of air knives 910 and 920, in the direction in which the substrate is conveyed, that is to say, to the right side in FIG. 14, so as to again adhere to the front and rear surface of dried substrate 90.

In addition, the liquid that has attached to the front and rear surface of substrate 90 is not entirely collected by mist collecting portions 912 and 922, even when converted to mist, and gathers on the rear portion side of the substrate as air knives 910 and 920 move, so as to adhere to end surface portion C on the rear portion of substrate 90, in the same manner as in the case of Patent Document 1, and thus, it is difficult to sufficiently dry substrate 90.

The present invention is provided in order to solve these problems, and an object thereof is to provide a method for removing deposit from a substrate and a method for drying a substrate where deposit, such as a liquid that has adhered to the front and rear surface of a substrate in an apparatus for processing a substrate in a previous step, is almost completely removed from the substrate, as well as an apparatus for removing deposit from a substrate and an apparatus for drying a substrate using these methods.

Means for Solving Problem

This invention provides a method for removing deposit from a substrate, wherein deposit that has attached to a main surface of a substrate is removed from the main surface of the substrate using air knife units in which a slit portion is formed so that a fluid can be discharged in band form, a fluid introduction path having an approximately uniform form in the direction perpendicular to the direction in which a number of air knife units move relative to a substrate is formed between the air knife units and the main surface of the substrate while the air knife units move relative to the substrate, a fluid is discharged toward the fluid introduction path from a slit portion that is formed in the rear portion of the above described air knife units, and then, passes through the fluid introduction path so as to be led to a wall surface that is formed so as to face the front portion of the air knife units or the above described fluid, which has the appearance of a wall surface, and furthermore, deposit on the substrate that has deposited on the substrate is led away from the main surface of the substrate, together with the above described fluid, via a fluid lead-out path which is formed between the air knife units and the wall surface so that the cross section of the flow path is greater than that of the fluid introduction path.

That is to say, in this fluid introduction path, a compressed fluid flow is gained that is uniform in the direction perpendicular to the direction in which the substrate moves. Deposit on the main surface of the substrate is mixed with the fluid in the fluid introduction path, and subsequently, led to the fluid lead-out path of which the cross sectional area is greater than that of the fluid introduction path. The fluid that has spread in the fluid lead-out path moves away from the main surface of the substrate along the wall surface including fine particles.

In addition, the present invention provides a method for drying a substrate, for removing a liquid that has attached to a main surface of a substrate from the main surface of the substrate using air knife units in which a slit portion is formed, so that a dry gas can be discharged in band form, wherein a fluid introduction path having an approximately uniform form in the direction perpendicular to the direction in which a number of air knife units move is formed between the air knife units and the main surface of the substrate while the air knife units move relative to the substrate, and a dry gas is discharged toward the fluid introduction path from slit portions which are formed in the rear portion of the above described air knife units, next, the dry gas passes through the fluid introduction path and is led to a wall surface that is formed in such a manner as to face the front portion of the air knife units, the above described wall surface is formed of a dry gas that is discharged from the slit portion of one air knife unit and a dry gas that is discharged from the slit portion of another air knife unit is led to the above described wall surface, and furthermore, a liquid that has attached to the substrate is led away from the main surface of the substrate, together with the above described dry gas, via a fluid lead-out path of which the cross sectional area of the flow path is greater than that of the fluid introduction path and which is formed between the air knife units and the wall surface.

That is to say, in this fluid introduction path, a compressed dry gas flow is gained that is uniform in the direction perpendicular to the direction in which the substrate moves relative to the air knife units. In the fluid introduction path, deposit (liquid) on the main surface of the substrate is mixed with a dry gas and led to the fluid lead-out path, of which the cross sectional area is greater than that of the fluid introduction path. The dry gas which has spread in the fluid lead-out path moves away from the main surface of the substrate along the fluid lead-out path, including fine particles (mist).

Another aspect of this invention provides an apparatus for removing deposit from a substrate, having: a number of air knife units where a slit portion is formed in the rear portion, so that pressurized fluid can be discharged in band form; air knife supporting portions for supporting air knife units so that a fluid introduction path is formed between the air knife units and the main surface of the substrate, in such a manner that the width of the gap between these is constant; and a substrate moving portion for moving an air knife unit and the substrate relative to each other in the direction perpendicular to the direction in which a liquid is discharged from the slit portion in a state where the above described fluid introduction path is formed, characterized in that the air knife supporting portions hold at least a pair of air knife units so that a fluid which is discharged from one slip portion and passes through the fluid introduction path has the appearance of a wall surface and changes the direction of the flow of a fluid which is discharged from the other slit portion to the direction away from the main surface of the substrate, and vice-versa, and thereby, deposit that has attached to the substrate is led away from the main surface of the substrate, together with the fluid, via a fluid lead-out path which is formed between the air knife units and the wall surface and of which the cross sectional area of the flow path is greater than that of the fluid introduction path.

That is to say, in this fluid introduction path, a compressed fluid flow is gained that is uniform in the direction perpendicular to the direction in which the substrate moves. In the fluid introduction path, deposit on the surface of the substrate is mixed with a fluid and led to the fluid lead-out path, of which the cross sectional area is greater than that of the fluid introduction path. In the fluid lead-out path, fluids flowing in opposite directions collide with each other in such a manner that the oncoming fluid has the appearance of a wall surface and the direction in which the fluid flows changes to the direction away from the main surface. Furthermore, the fluid which has been led to the fluid lead-out path from the fluid introduction path and spread in the fluid lead-out path flow in such a manner as to mix with deposit as fine particles and move away from the main surface of the substrate along the wall surface.

In addition, the present invention provides an apparatus for removing deposit from a substrate, having: a number of air knife units, where a slit portion is formed in the rear portion, so that a pressurized fluid can be discharged in band form; air knife supporting portions for supporting the air knife units in such a manner that a fluid introduction path is formed between the air knife units and a main surface of a substrate, so that the width of the gap between these is constant; and a substrate moving portion for moving the air knife units and the substrate relative to each other in a state where the above described fluid introduction path is formed, characterized in that the air knife supporting portions hold a number of air knife units, so that the direction of the flow of a fluid which is discharged from one slit portion and passes through the fluid introduction path is changed to the direction away from the main surface of the main surface by means of the rear surface of another air knife unit, and thereby, deposit that has attached to the substrate is led away from the main surface of the substrate, together with the fluid, via a fluid lead-out path which is formed between the air knife units and the wall surface, and of which the cross sectional area of the flow path is greater than that of the fluid introduction path.

That is to say, in this fluid introduction path, a compressed fluid flow is gained that is uniform in the direction perpendicular to the direction in which the substrate moves. In the fluid introduction path, deposit on the surface of the substrate is mixed with a fluid and led to the fluid lead-out path, of which the cross sectional area is greater than that of the fluid introduction path. In the fluid lead-out path, the fluid collides with the rear surface of an air knife which is located in the front, and the rear surface becomes a wall surface, and thus, the direction in which the fluid flows changes to the direction away from the main surface. Furthermore, the fluid which has been led to the fluid lead-out path from the fluid introduction path and spread in the fluid lead-out path flow in such a manner as to mix with deposit as fine particles and move away from the main surface of the substrate along the wall surface. Furthermore, the fluid which has been led to the fluid lead-out path from the fluid introduction path and spread in the fluid lead-out path flow in such a manner as to mix with deposit as fine particles and move away from the main surface of the substrate along the wall surface.

In the present invention, "fluid" includes gases such as dry air, nitrogen, helium, argon, and in addition, includes liquids such as water, cleaning liquids, solvents, processing liquids, such as etchant, polishing water and cutting water, and furthermore, includes mixed fluids of water and compressed air, as well as mixed fluids of a cleaning liquid and compressed air.

In the present invention, "substrate" includes brittle material substrates such as glass substrates, metal substrates such as steel plates, wood plates, plastic substrates, printed substrates, ceramic substrates and semiconductor substrates. Here, all of these "substrates" may be a single plate or a bonded substrate. In particular, the substrates include panel substrates, such as plasma display panels, liquid crystal display panels, reflective projector display panels, transmission projector panels, organic EL display panels and field emission display apparatus (FED) panels, which are panel substrates for flat panel display devices (FPD), as well as the mother substrates thereof.

"Deposit on a substrate" in the present invention is a substance which attaches to the surface of a substrate which is an object to be processed, and includes the material of the substrate, for example, powder from cutting, pieces created as a result if processing, and the material of the processing means originating from the processing means, for example, a cleaning liquid or abrasive grains.

In the present invention, "removal of deposit from a substrate" means a process for removing deposit on a substrate as that described above from the substrate using a fluid that is jetted from an air knife unit, and includes drying processes for removing a liquid from a substrate using a gas that is jetted from an air knife unit, as well as cleaning processes for removing a solid or a liquid from a substrate using a liquid that is jetted from an air knife unit.

In the present invention, "Venturi effect" means a working effect such that when a fluid that has been jetted from the slit of an air knife unit sequentially passes through a slit opening of which the flow path has a large cross sectional area, a fluid introduction path of which the flow path has a small cross sectional area which is formed between the air knife units and the substrate, and the fluid introduction path of which the flow path has a large cross sectional area, the flow rate increases in the fluid introduction path and an air knife unit is drawn to the substrate due to the negative pressure caused between the air knife unit and the substrate.

EFFECTS OF THE INVENTION

In the method for removing deposit from a substrate, a fluid on a substrate is compressed in a fluid introduction path, and then, the fluid spreads in the fluid lead-out path, and therefore, the deposit on the main surface of the substrate is converted to microscopic particles without aggregating and can be easily removed from the main surface of the substrate.

The Venturi effect between an air knife unit and the main surface of the substrate is used when a fluid passes through the fluid lead-out path, and the air knife unit is supported relative to the main surface of the substrate in such a manner as to fluctuate, so that the clearance between the air knife unit and the main surface of the substrate is adjusted, and therefore, effects can be gained, such that the air knife unit follows bending and inclination of the substrate in a simple mechanism, so that the above described clearance can be stably maintained.

Air knife units are paired in the configuration, and in each pair, a fluid that is discharged from the slit portion of one air knife unit has the appearance of a wall surface and a fluid that is discharged from the slit portion of the other air knife is made to collide with the above described wall surface, and furthermore, the above described fluid is led away from the main surface of the substrate via the above described fluid lead-out path, and therefore, reduction in the size of the particles of the deposit is accelerated.

The air knife units are aligned parallel to each other, the rear portion of one air knife unit in each adjacent pair of air knife units is used as a wall surface, and a fluid that is discharged from the slit portion of the other air knife unit is led to the above described wall surface, and furthermore, the above described fluid is led away from the main surface of the substrate via the above described fluid lead-out path, and therefore, reduction in the size of the particles of the deposit is accelerated.

At least one air knife unit is provided on each of the two main surfaces, front and rear, of the substrate, and therefore, removal of the deposit on the substrate from the two main surfaces, front and rear, of the substrate can be carried out simultaneously.

The fluid that has been led away from the main surface of the substrate is forcefully captured, and therefore, the deposit that has been removed from the main surface of the substrate can be prevented from attaching to the substrate again.

The fluid that is discharged from the slit portions is a gas for drying a substrate and a liquid for cleaning a substrate, and therefore, it becomes possible to clean the main surface of the substrate with a liquid for cleaning a substrate, and after that, dry the main surface of the substrate that has been cleaned.

In accordance with the method for drying a substrate, a dry gas is compressed in the fluid introduction path, and then, the dry gas spreads in the fluid lead-out path, and therefore, deposit (liquid) on the main surface of the substrate is mixed with the dry gas, so that the particles thereof are reduced in size (converted to mist) without aggregation, and thereby, the liquid can be easily and almost completely removed from the main surface of the substrate, so that the main surface of the substrate is dried.

In accordance with the apparatus for removing deposit from a substrate, a fluid is compressed in the fluid introduction path, and then, a flow in the direction away from the main surface of the substrate is gained in the fluid lead-out path, and therefore, the fluid can be easily and almost completely removed from the main surface of the substrate.

The air knife supporting portions has a clearance adjusting means for adjusting the clearance between the air knife units and the main surface of the substrate using the Venturi effect when the fluid passes through the fluid introduction path, and therefore, the air knife unit can follow bending and the like of the substrate in a simple mechanism, and the above described clearance can be stably maintained.

The clearance adjusting means is provided with an elastic member for supporting an air knife unit relative to the main surface of the substrate in such a manner as to fluctuate, and a laminar flow creating surface which is formed on one side of an air knife unit which faces the main surface of the substrate and forms a portion of the flow introduction path and allows a fluid to pass between the laminar flow creating surface and the main surface of the substrate in a state of laminar flow, and therefore, a laminar flow passes through the fluid introduction path, which is formed of the laminar flow creating surface and the main surface of the substrate, and thereby, negative pressure is created in the vicinity of the main surface of the substrate (Venturi effect), in such a manner that the force in the direction upward from the elastic member for holding an air knife unit and the suction force for attracting an air knife unit resulting from the above described negative pressure are balanced, and thereby, the above described fluid introduction path having an approximately uniform form between the air knife unit and the main surface of the substrate can be formed.

At least one air knife unit is placed on each of the two main surfaces, front and rear, of the substrate, and therefore, removal of deposit from the substrate, from the two main surfaces, front and rear, of the substrate can be carried out simultaneously.

A capturing means for capturing a fluid which has been led out from the main surface of the substrate along the fluid lead-out path is further provided, and therefore, effects can be gained, such that there is no risk that the deposit that has been removed from the main surface of a substrate may attach to the substrate again.

In the apparatus for drying a substrate, a dry gas is compressed in the fluid introduction path, and then, the dry gas spreads in the fluid lead-out path, and therefore, deposit (liquid) on the main surface of the substrate is mixed with the dry gas, so that the particles thereof are reduced in size (converted to mist) without aggregation, and thereby, the liquid can be easily and almost completely removed from the main surface of the substrate.

EXPLANATION OF SYMBOLS

Figure 1:
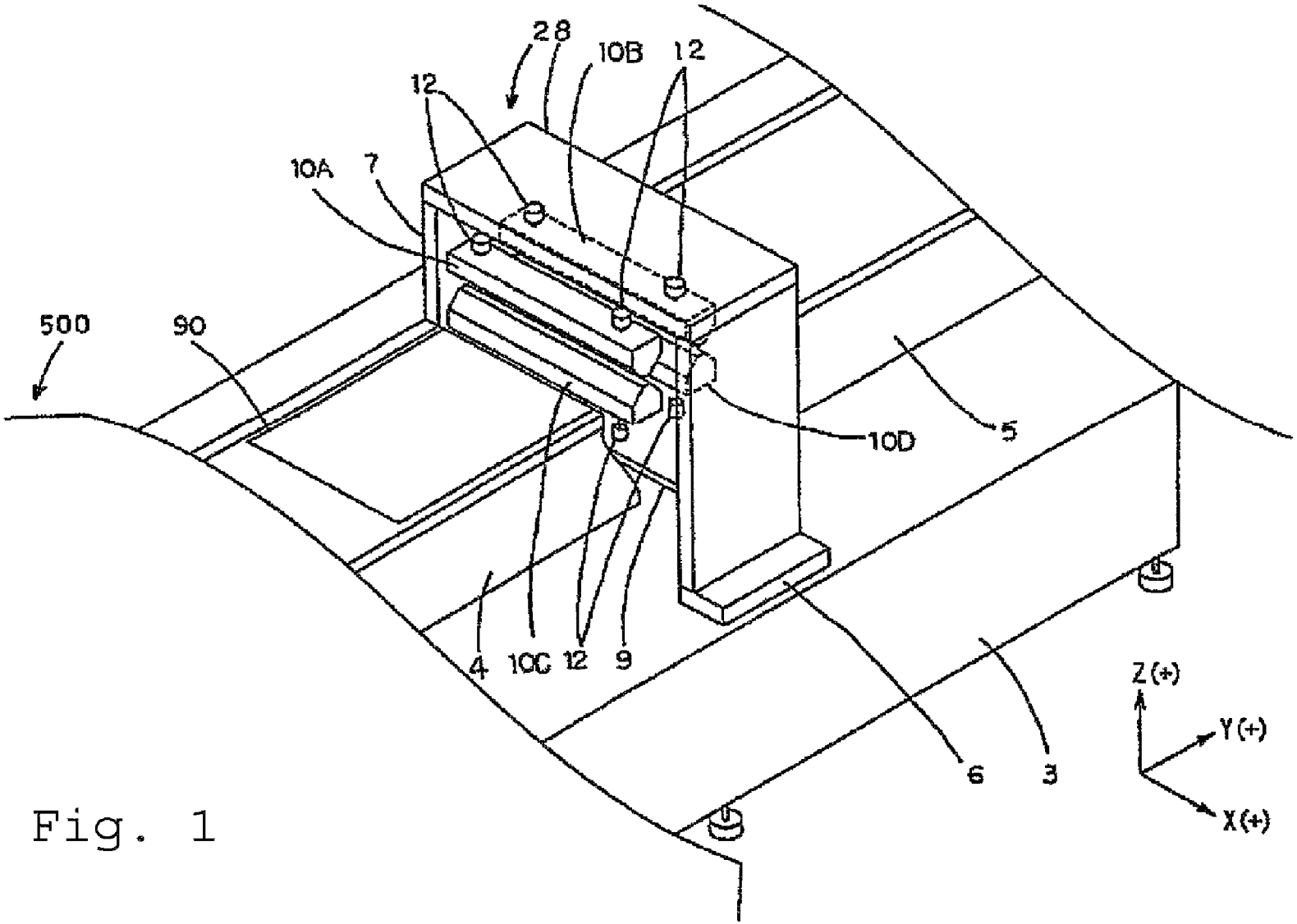
FIG. 1 is a perspective diagram showing an example of an apparatus for processing a substrate of the present invention.

1 apparatus for drying substrate
2 portion for processing substrate
4 upstream conveyor
5 downstream conveyor
10A air knife assembly
10B air knife assembly
10C air knife assembly
10D air knife assembly
12 unit holding portion
15 air knife unit
15*f* laminar flow creating surface
17 slit for jetting fluid
30 unit holding portion
50 fluid introduction path
60 fluid lead-out path
90 substrate
100 apparatus for drying substrate
150 apparatus for drying substrate
160 coupled air knife unit
200 apparatus for drying substrate
201 suction cover
202 flange
500 apparatus for processing substrate
900 apparatus for processing substrate
910 upper air knife
920 lower air knife

BEST MODE FOR CARRYING OUT THE INVENTION

In the following, the embodiments of the present invention are described. Here, the present invention is not limited to the following embodiments.

First Embodiment

In this first embodiment, an apparatus for drying a substrate is described as an apparatus for removing deposit from a substrate.

FIG. 1 is a schematic perspective diagram showing an example of an apparatus for drying a substrate of the present invention. This apparatus for drying a substrate dries a substrate 90 by removing a liquid that has attached to the front and rear surface of substrate 90 in a step after an apparatus for processing a substrate 500 has processed substrate 90.

Apparatus for processing a substrate 500 in the previous step is, for example, an apparatus for cleaning a substrate, an apparatus for polishing a substrate, a dicing apparatus, an apparatus for etching a substrate or the like. Here, in some cases, an apparatus for drying a substrate 1 of the present invention may be provided within apparatus for processing a substrate 500 in the previous step.

An apparatus for drying a substrate 1 is formed of a portion for processing a substrate 2 which is provided on a support 3, an upstream conveyor 4 and a downstream conveyor 5, which are provided in the front and rear of portion for processing a substrate 2. A substrate 90 that has been transferred from apparatus for processing a substrate 500 is conveyed in the direction +Y through upstream conveyor 4, portion for processing a substrate 2 and downstream conveyor 5. Upstream conveyor 4 and downstream conveyor 5 are belt conveyors which use a woven cloth in sheet form or roller conveyors using rollers.

Portion for processing a substrate 2 is provided with the below described air knife units which are placed above and below substrate 90 that is conveyed.

The air knife unit located above substrate 90 is formed mainly of a pair of air knife assemblies 10A and 10B, a pair of unit holding portions 12 and 12 for holding air knife assemblies 10A and 10B, respectively, and an upper attachment base 8 to which unit holding portions 12 and 12 are attached.

The air knife unit located below substrate 90 is formed mainly of a pair of air knife assemblies 10C and 10D, a pair of unit holding portions 12 and 12 for holding air knife assemblies 10C and 10D, respectively, and a lower attachment base 9 to which unit holding portions 12 and 12 are attached.

Portion for processing a substrate 2 is formed of stands 6 and 7, which are provided on support 3, and upper attachment base 8 and lower attachment base 9, which are provided between stands 6 and 7.

Air knife assemblies 10A and 10B are respectively provided on the lower surface of upper attachment base 8 with unit holding portions 12 and 12 in between, so that the longitudinal direction of respective air knife assemblies 10A and 10B is the same as direction X perpendicular to the direction (+Y), which is the direction in which substrate 90 is conveyed.

Air knife assemblies 10C and 10D are respectively provided on the lower surface of lower attachment base 9 with unit holding portions 12 and 12 in between, so that the longitudinal direction of respective air knife assemblies 10C and 10D is the same as direction X perpendicular to the direction (+Y), which is the direction in which substrate 90 is conveyed.

Figure 2:
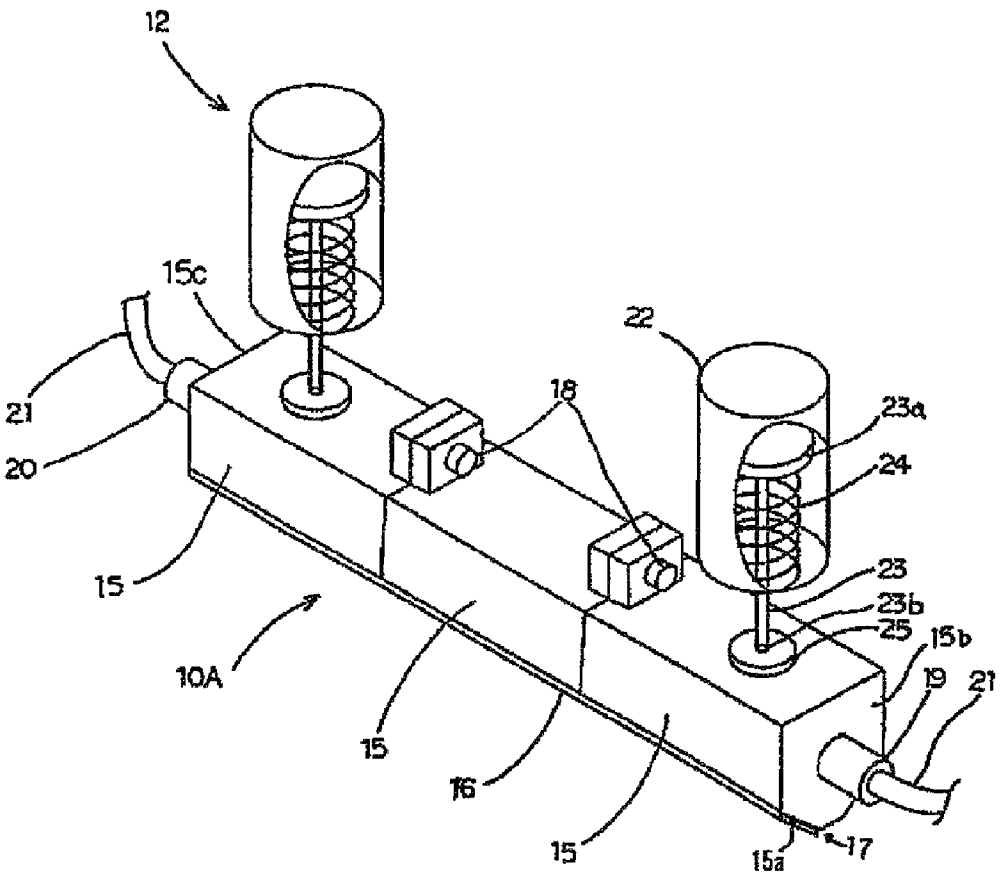
FIG. 2 is a schematic perspective diagram showing air knife units and unit holding portions for holding these air knife units.

FIG. 2 is a schematic perspective diagram showing air knife assembly 10A.

Air knife assembly 10A is formed of unit holding portion 12 for holding air knife assembly 10A to upper attachment base 8, not shown, which would be at the top in the drawing, if shown, and a number of air knife units 15. Air knife assembly 10A is formed of a number of air knife units 15 (three air knife units 15 are used in FIG. 2), which are coupled in a line by means of bolts 18.

A slit for jetting a fluid 17 is formed in air knife units 15. The surface for blowing out compressed air from slit for jetting a fluid 17 is formed on an inclined surface 15*a* of air knife units 15, and a cover 16 which is attached to this inclined surface 15*a* allows compressed air to be jetted along inclined surface 15*a*.

Connectors 19 and 20 are respectively attached to both sides 15*b* and 15*c* of air knife assembly 10A, and tubes 21 are respectively connected to connectors 19 and 20. Furthermore, compressed air is supplied to the inside of air knife assembly 10A through tubes 21 from a compressed air supplying source, not shown.

The pair of unit holding portions 12 and 12 for holding air knife assembly 10A is provided with, for example, a rod 23 having a sliding portion 23*a* which slides inside a casing 22, and is formed of a compressive spring 24 through which rod 23 is inserted between sliding portion 23*a* of rod 23 and the inner surface of casing 22 on the end portion 23*b* side of rod 23. An attachment member 25 which is attached to the end portion of rod 23 is attached to the top surface of an air knife unit 15 using bolts or the like. In addition, the top surface of casing 22 on the side opposite to the end portion 23*b* side of rod 23 of unit holding portion 12 is attached to upper attachment base 8 in such a manner that air knife assembly 10A is directed in direction X.

Here, air knife assembly 10B is basically the same as air knife assembly 10A, and air knife assembly 10C is the same as air knife assembly 10B. In addition, air knife assemblies 10A and 10B are the same as air knife assemblies 10C and 10D.

Figure 3:
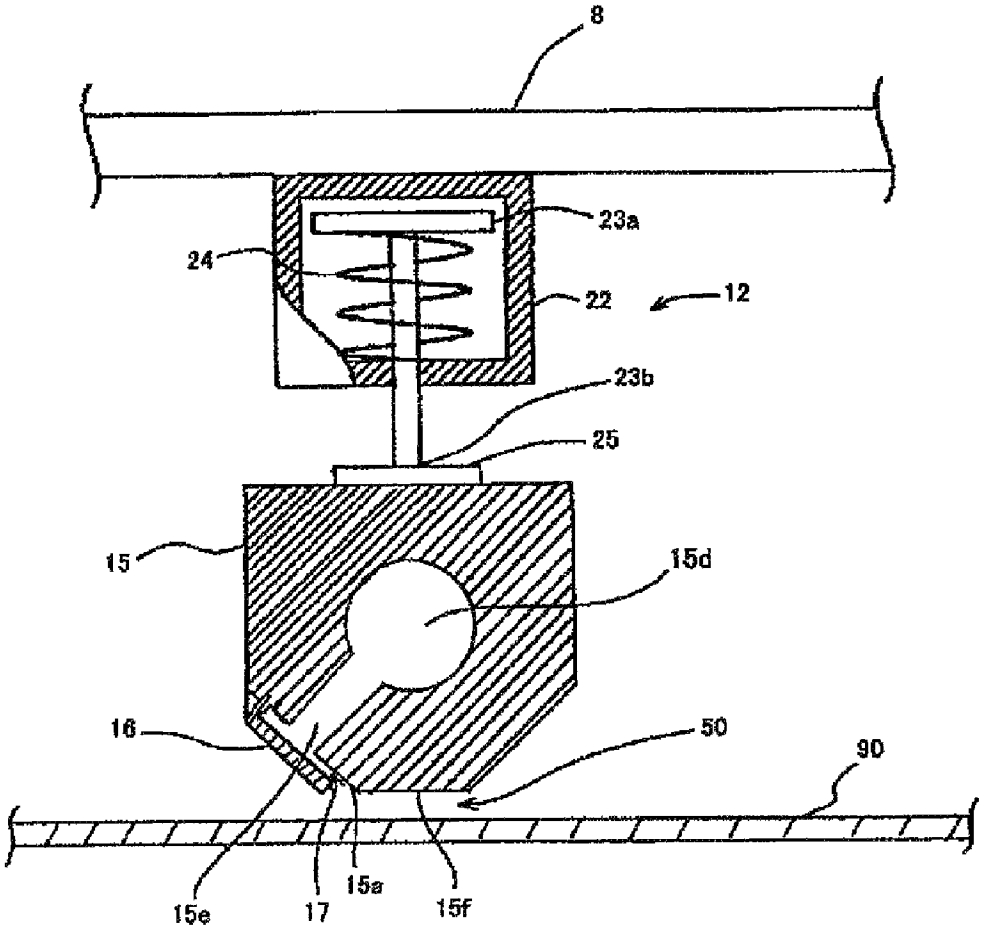
FIG. 3 is a cross sectional diagram showing the structure of an air knife which forms part of an air knife unit.

FIG. 3 is a cross sectional diagram showing the structure of air knife assemblies 10A to 10D.

As described above, air knife assemblies 10A to 10B all have the same structure, and therefore, air knife assembly 10A is described herein.

An air knife unit 15 is provided with a through hole 15*d* which penetrates in the longitudinal direction thereof, and a long hole 15*e* which connects to this through hole 15*d* has an opening in an inclined surface 15*a* of air knife unit 15. In addition, surface 15*a* of air knife 15 is provided with a cover 16 in L shape. A slit for jetting a fluid 17 is formed between cover 16 and air knife unit 15.

In air knife assemblies 10A to 10D, a compressed fluid which has been supplied to through hole 15*d* of an air knife from connectors 19 and 20 (FIG. 2) which are provided in air knife assembly 10A passes through long hole 15*e*, flows along inclined surface 15A of air knife 15 and is blown out from slit for jetting a fluid 17. Here, in FIG. 2, the direction in which the fluid is jetted from air knife assembly 10A is direction +Y, while the direction in which the fluid is jetted from air knife assembly 10B is direction −Y, and in the same manner, the direction in which the fluid is jetted from air knife assembly 10C is direction +Y, while the direction in which the fluid is jetted from air knife assembly 10D is direction −Y.

In addition, FIG. 3 is a diagram showing a means for automatically adjusting the clearance which adjusts the clearance between air knife unit 15 and a main surface of a substrate 90 in air knife assembly 10A. The means for automatically adjusting the clearance is formed on the lower portion (bottom surface) of air knife unit 15, as shown in FIG. 3, and thus, is formed of a laminar flow creating surface 15*f* which allows a fluid to pass in the state of laminar flow between the means for automatically adjusting the clearance and the main surface of the substrate, and the above described unit holding portion 12 for holding air knife unit 15 in such a manner as to fluctuate.

The operation of automatically adjusting the clearance in unit holding portion 12 by the means for automatically adjusting the clearance is described below.

A fluid that is discharged from slit for jetting a fluid 17 passes through fluid introduction path 50 which is formed between laminar flow creating surface 15*f* and the main surface of substrate 90 as a compressed laminar flow. Therefore, negative pressure is created on the surface of substrate 90 (Venturi effect), so that the suction force resulting from this negative pressure for attracting laminar flow creating surface 15*f* of air knife unit 15 and the holding force for holding air knife assembly 10A in the upward direction of compressive spring 24 of unit holding portion 12 are balanced. As a result, a clearance which is uniform in the longitudinal direction of air knife assembly 10A is created between air knife assembly 10A and substrate 90.

The size (gap) of the above described clearance can be adjusted by changing at least one of the flow amount of the fluid which is discharged from slit for jetting a fluid 17, the pressurizing force for compressing the fluid and the flow rate of the fluid which passes through laminar flow creating surface 15*f*. Accordingly, air knife assembly 10A can be made close to the limit to substrate 90 without making contact.

Next, the operation of drying a substrate in apparatus for drying a substrate 1 is described. For the sake of description, mainly the operation of air knife assemblies 10A and 10B which are located above substrate 90 described.

Figure 4:
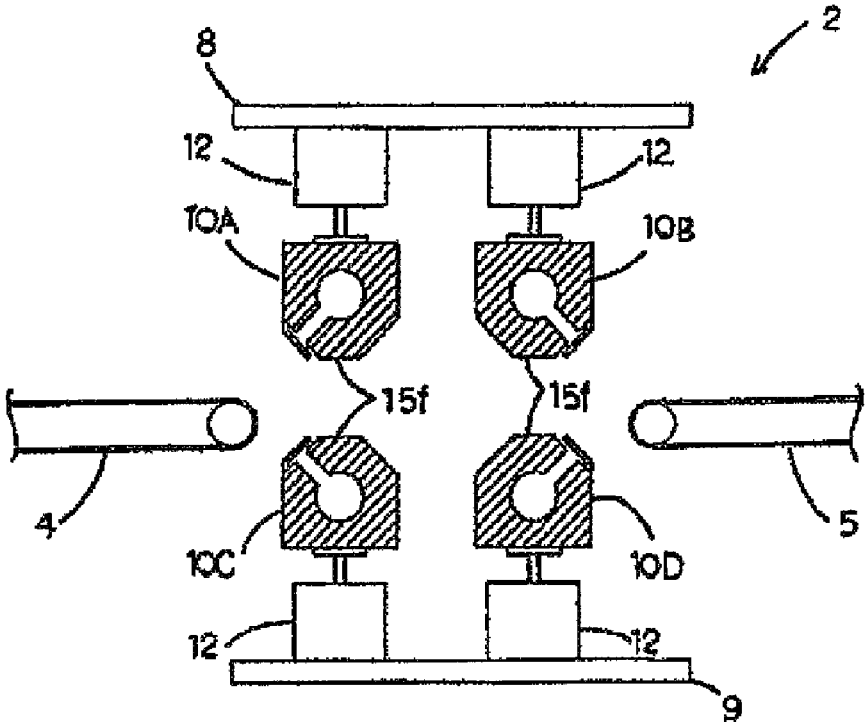
FIG. 4 is a diagram showing the state of air knife units before a substrate is conveyed to a portion for processing a substrate.
Figure 5:
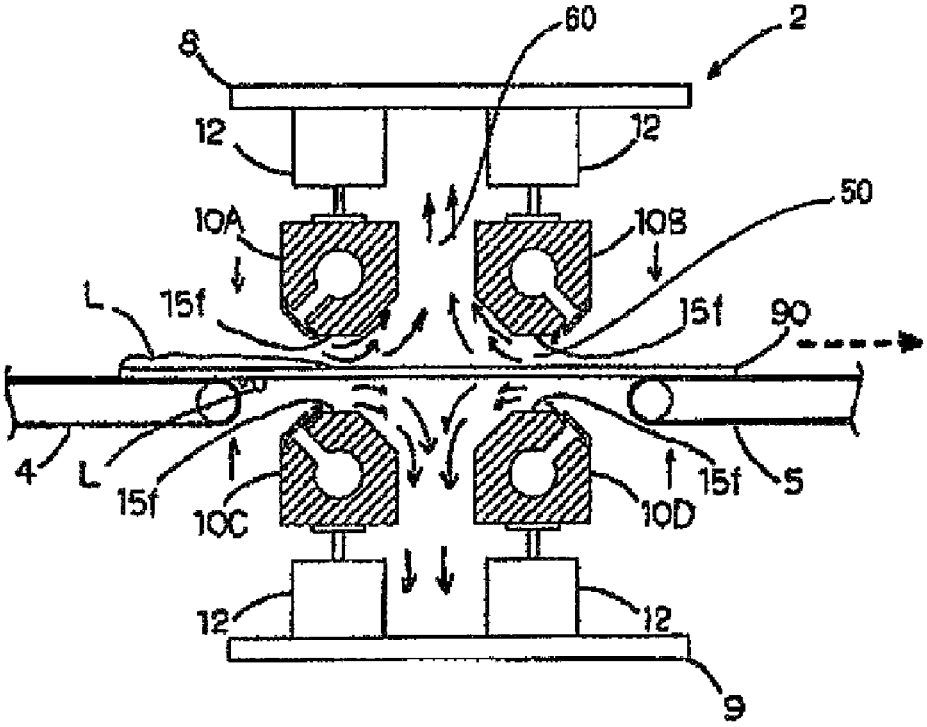
FIG. 5 is a diagram showing the state of air knife units when the front and rear surface of a substrate is processed.

FIG. 4 is a diagram showing the state of the air knife unit before substrate 90 is conveyed to portion for processing a substrate 2, and FIG. 5 is a diagram showing the state of the air knife during removal of a liquid that has attached to the front and rear surface of substrate 90 after substrate 90 has been conveyed to portion for processing a substrate 2.

First, as shown in FIG. 1, substrate 90 which has been discharged from apparatus for processing a substrate 500 in the previous step is mounted on an upstream conveyor 4 and sent to portion for processing a substrate 2. In portion for processing a substrate 2, as shown in FIG. 4, air knife assemblies 10A/10B and air knife assemblies 10C/10D face each other in such a manner as to have a gap of several mm vis-à-vis the two main surfaces of substrate 90 that is being conveyed, and are on standby.

As shown in FIG. 5, when substrate 90 is conveyed to portion for processing a substrate 2 in the direction of the arrow in the figure by upstream conveyor 4, dry air is supplied to air knife assemblies 10A to 10D. In addition, at the point when substrate 90 passes through laminar flow creating surface 15*f* of air knife unit 15 of each of air knife assemblies 10A and 10C, dry air flows through fluid introduction paths 50 between substrate 90 and respective laminar flow creating surfaces 15*f*. As a result, negative pressure is respectively created in the vicinity of the front and rear surface of substrate 90, and air knife assemblies 10A and 10C, approach or move away from such a position that a clearance of approximately 20 μm to 100 μm is maintained from the front and rear surface of substrate 90.

Wall surfaces are formed of air (referred to as wall surfaces because the air works as and has the appearance of a wall, though air is a gas) which is discharged from respective slits 17 of air knife assemblies 10A to 10D between air knife assemblies 10A and 10B, and between air knife assemblies 10C and 10D (air walls).

That is to say, one of the above described air walls is made up of dry air that is discharged from slit 17 of one air knife assembly 10A, and dry air which is discharged from slit 17 of air knife assembly 10B facing the above described air knife assembly 10A is led to the above described wall surface. Here, these working effects are the same for each unit of air knife assemblies 10A to 10D.

Meanwhile, dry air that has been discharged from air knife assemblies 10A and 10C passes through fluid introduction path 50 of which the cross sectional area of the path is extremely small between the substrate and laminar flow creating surface 15*f* of air knife unit 15 of air knife assemblies 10A and 10C, and the dry air that has been led to the above described wall surface is changed in the direction of the flow by this wall surface, and furthermore, the liquid that has attached to substrate 90 is led away from the main surface of substrate 90, together with the above described dry air, via fluid lead-out path 60, which is formed between air knife unit 15 and the wall surface so as to that the cross sectional area of the flow path is greater than that of fluid introduction path 50.

Liquid L that has attached to the front and rear surface of substrate 90 is blown out at one stretch from fluid introduction path 50 of which the cross sectional area of the path is small to fluid lead-out path 60 of which the cross sectional area of the path is large and spreads, and thereby, is converted to mist. At this time, dry air is mixed with liquid L that was attached to the front and rear surface of substrate 90, and rises along fluid lead-out path 60 so as to move away from the front and rear surface of substrate 90 (here, dry air that has been discharged from air knife assemblies 10B and 10D descends). As a result of this conversion of liquid L to mist and change in direction of 90°, mist can be prevented from attaching to the front and rear surface of substrate 90 again as liquid L.

Furthermore, in the case where a hole for sucking air (not shown) is provided in the vicinity of substrate 90, dry air that includes mist flows from substrate 90 directly into the above described hole for sucking air, and therefore, mist that has risen does not attach to substrate 90 again.

In this first embodiment, liquid L does not aggregate on the front and rear surface of substrate 90, is mixed with dry air, so that the size of the particles is reduced, and is carried by the flow of the dry air so as to move away from substrate 90, and therefore, liquid L can be easily and almost completely removed from the front and rear of substrate 90.

At least one air knife is placed on each side, the front and rear surface, of substrate 90, and therefore, liquid L can be simultaneously removed from the front and rear surface of substrate 90.

Unit holding portions 12 for holding air knife assemblies 10A to 10D have a means for automatically adjusting the clearance which adjust the clearance between air knife assemblies 10A to 10D and the front and rear surface of substrate 90 using the Venturi effect which results when the fluid passes through fluid introduction path 50, and therefore, the above described clearance can be adjusted in accordance with the viscosity and adhesiveness of the object to be removed that has attached to the front and rear surface of substrate 90, so that removal can be easily carried out for various types of objects to be removed.

Second Embodiment

Another mode of the means for adjusting the clearance is shown in the second embodiment.

Figure 6:
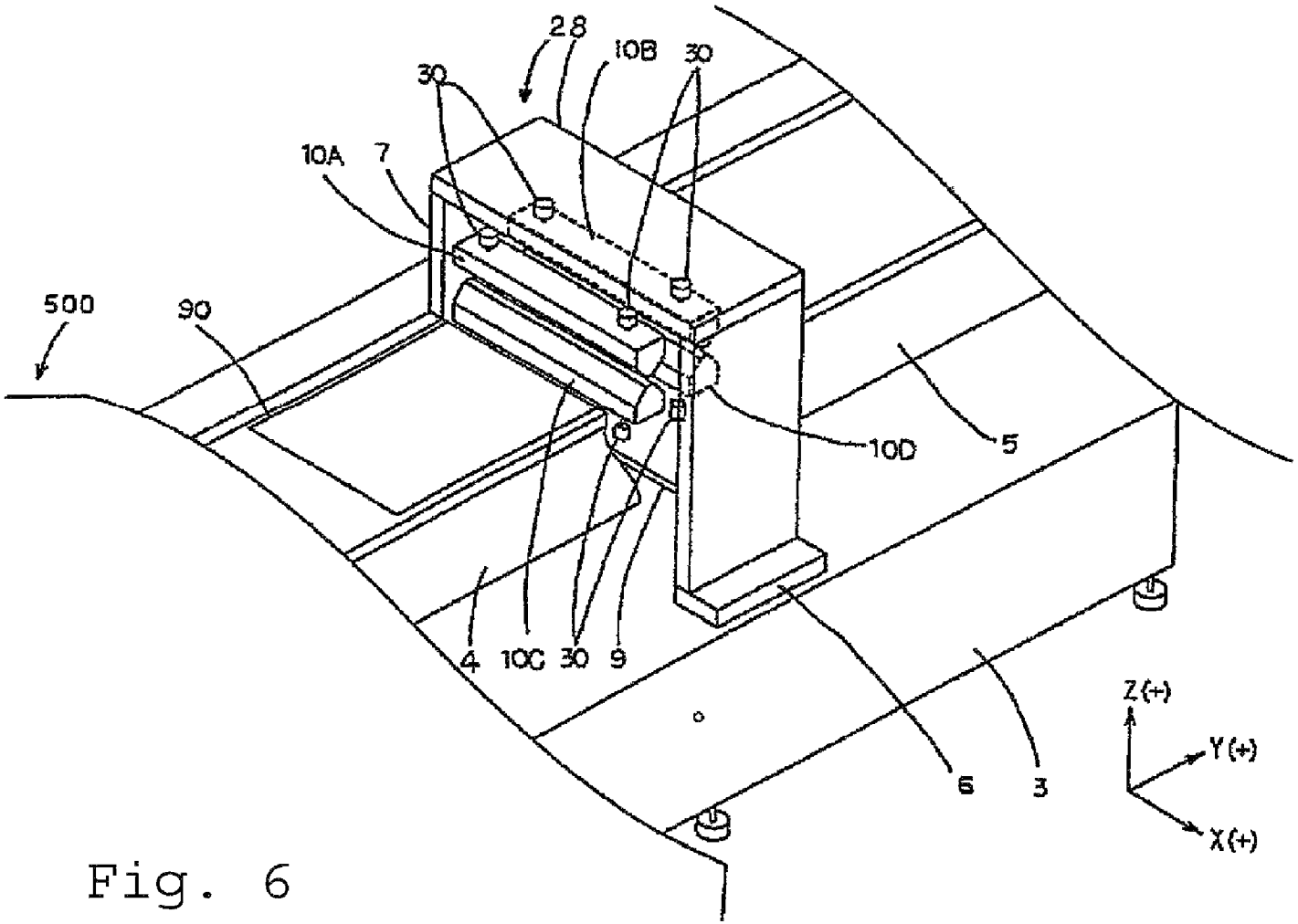
FIG. 6 is a perspective diagram showing an apparatus for processing a substrate according to the second embodiment of the present invention.

FIG. 6 is a schematic perspective diagram showing an apparatus for drying a substrate according to the second embodiment of the present invention.

The apparatus for drying a substrate 100 of FIG. 6 is not structurally different from apparatus for drying a substrate 1 in the first embodiment, but unit holding portion 12 of portion for processing a substrate 2 is replaced with another unit holding portion 30, and therefore, description of the respective members is omitted, and the same symbols as those in the first embodiment are used for corresponding members.

Figure 7:
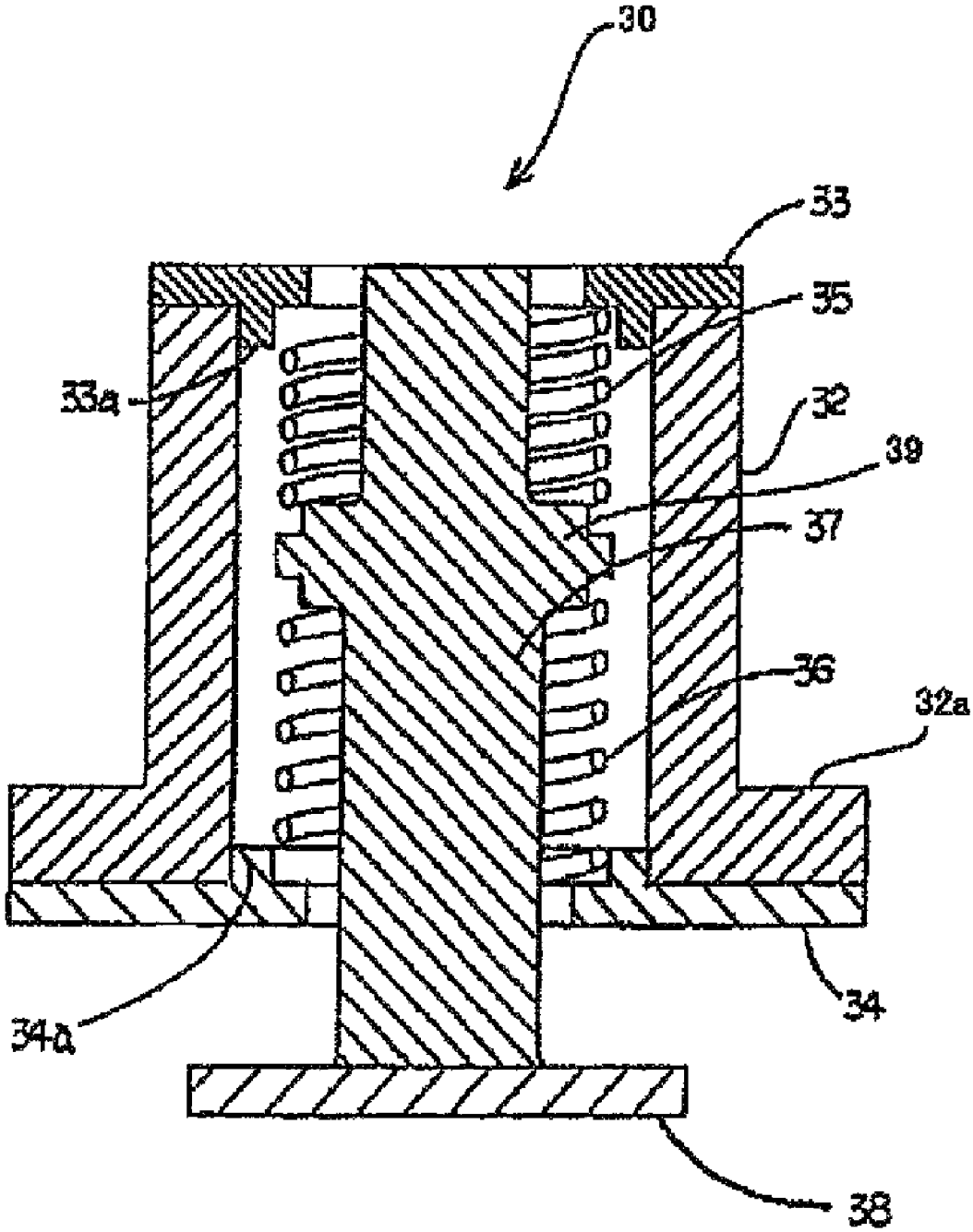
FIG. 7 is a cross sectional diagram showing the configuration of another unit holding portion.

FIG. 7 is a schematic cross sectional 1 diagram showing the configuration of unit holding portion 30.

Unit holding portion 30 is described in reference to FIG. 7.

A casing 32 is a member in cylindrical form where a flange 32*a* is formed in such a manner as to be integrated with the lower portion, and has a clearance within which upper spring 35 and lower spring 36 which make contact with a step portion of a shaft 37 freely change in form within casing 32. Flange portion 32*a* is provided to secure casing 32 to a lower casing plate 34, and has a sufficient thickness for allowing a hole for a screw for fixing to be created. Upper casing plate 33 has a first opening in the center, and secures the upper portion of upper spring 35 while holding shaft 37 via upper spring 35 and lower spring 36, so that shaft 37 freely moves upward and downward, and upper casing plate 33 is secured to the upper end surface of casing 32 with screws.

A protrusion 33*a* in ring form is provided on the inner side of upper casing plate 33. A lower casing plate 34 is formed of a circular plate, has a second opening in the center, and is provided with a protrusion 34*a* in ring form on the inner side. Protrusion 33*a* restricts the upper end of upper spring 35, so that the position thereof becomes such that the spring is coaxial with upper casing plate 33, while protrusion 34*a* restricts the lower end of lower spring 36, so that the position thereof becomes such that the spring is coaxial with lower casing plate 34. In addition, the inner side of the first opening in the center of upper casing plate 33 and the second opening in the center of lower casing plate 34 makes contact with shaft 37, so that the inclination of shaft 37 is restricted. Shaft 37 is elastically supported by upper spring 35 and lower spring 36 which make contact with step portion 39, in such a manner that it can incline within casing 32 within the range allowed by the above described restriction, and can move slightly in the axial direction and in the direction diagonal to this axial direction.

A metal attachment 38 is attached to the end of shaft 37 on the lower spring 36 side. Metal attachment 38 is joined to each of air knife assemblies 10A to 10D using bolts or the like. In addition, upper casing plate 33 is joined to upper attachment base 8 or lower attachment base 9 of FIG. 3 using bolts or the like.

Unit holding portions 30 as that of FIG. 7 are adopted in portion for processing a substrate 2 in apparatus for drying a substrate 100 according to the present invention, and therefore, even in the case where substrate 90 inclines in the upward and downward direction (direction Z) approximately along direction X because of inconsistencies in the installation of upper conveyor 4, portion for processing a substrate 2 and lower conveyor 5, an appropriate gap between laminar flow creating surface 15*f* of air knife assemblies 10A to 10D and the front and rear surface of substrate 90 can be maintained when substrate 90 is processed by portion for processing a substrate 2. Approximately 20 μm to 100 μm can be cited as an example of the gap between laminar flow creating surface 15*f* and the front or rear surface of substrate 90.

In addition, unit holding portion 30 allows for precession of shaft 37, and shaft 37 in a state of precession returns to such a state as to face a predetermined direction as a result of the force of the springs inside unit holding portion 30. As a result, air knife assemblies 10A to 10D can maintain an appropriate gap between laminar flow creating surfaces 15*f* and the front and rear surface of substrate 90 while changing the position thereof following the inclination of substrate 90.

Third Embodiment

Another mode of the air knife unit is shown in the third embodiment.

The third embodiment is different form the first and second embodiments in that a pair of air knife units are coupled and integrated, and a number of holes for releasing a fluid are formed in the integrated unit.

Figure 8:
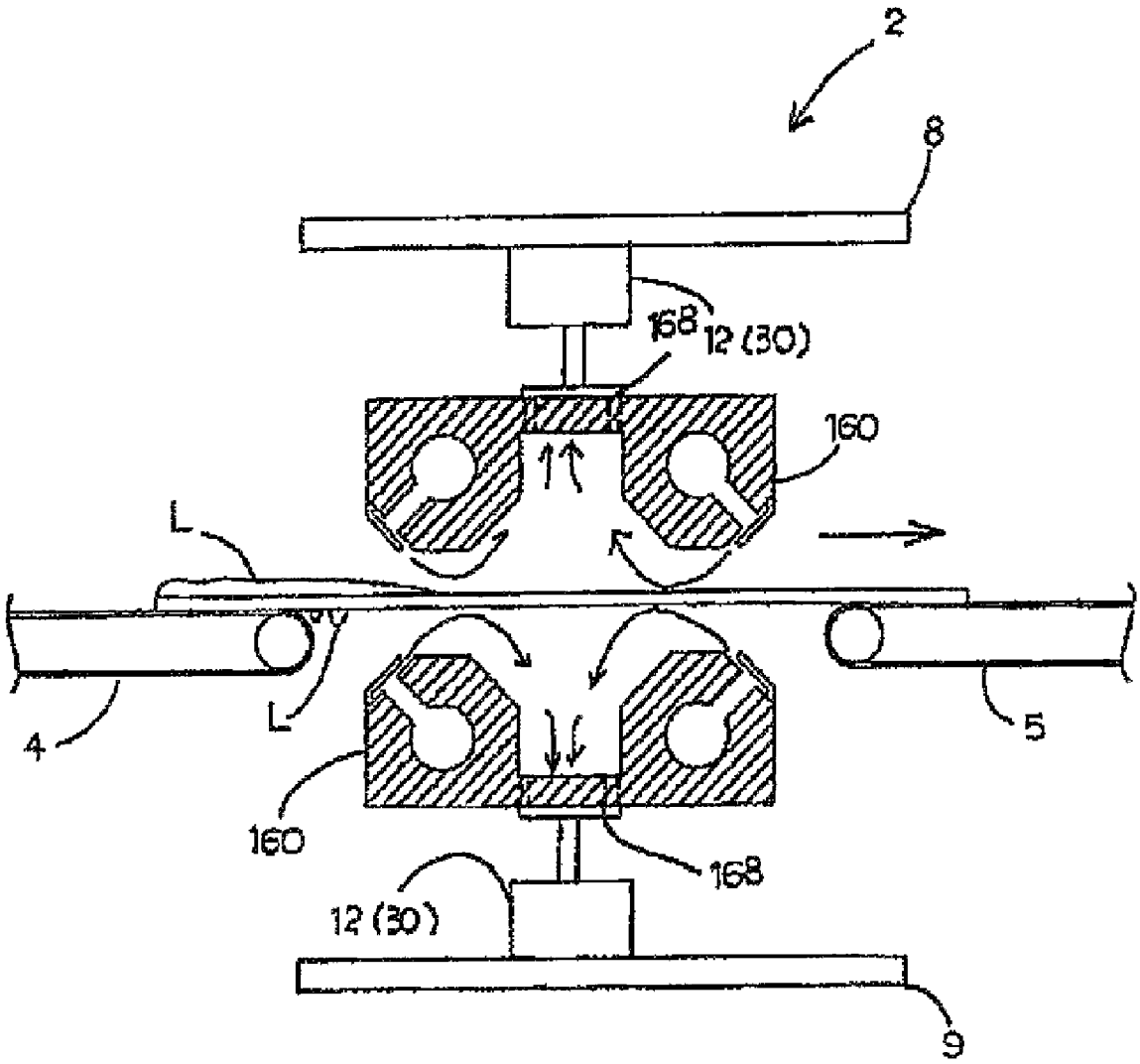
FIG. 8 is a schematic cross sectional diagram showing portion for processing a substrate 2 in the apparatus for removing deposition from a substrate according to the third embodiment of the present invention.

FIG. 8 is a cross sectional diagram showing portion for processing a substrate 2 of apparatus for drying a substrate 150 according to the third embodiment of the present invention.

Figure 9:
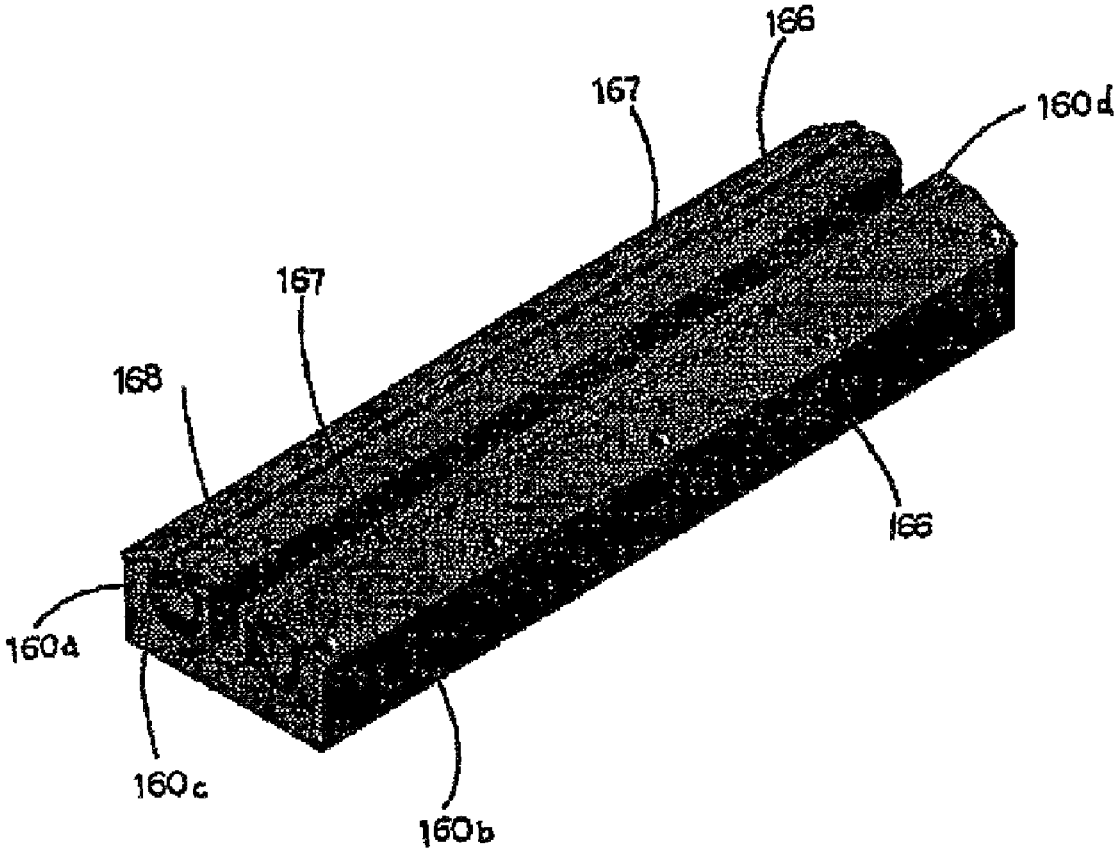
FIG. 9 is a perspective diagram showing coupled air knife unit 160 which is provided in portion for processing a substrate 2 in apparatus for removing deposition from a substrate 150 according to the third embodiment of the present invention.

FIG. 9 is a perspective diagram showing the appearance of coupled air knife unit 160 which is provided in portion for processing a substrate 2 of apparatus for drying a substrate 150 according to the third embodiment of the present invention.

As shown in FIGS. 8 and 9, this coupled air knife unit 160 is held by the pair of unit holding portions 12 and 12 of the first embodiment or the pair of unit holding portions 30 and 30 of the second embodiment, and the unit holding portions are linked to upper attachment base 8 and lower attachment base 9 using bolts and the like, in such a manner that coupled air knife unit 160 is directed in direction X, which is perpendicular to the direction (direction +Y) in which substrate 90 progresses.

As shown in FIG. 9, coupled air knife unit 160 has a number of holes 168 (broken line portions in FIG. 8) for releasing a fluid, and is gained by integrally forming air knife unit portions 160*a* and 160*b* in such a manner that slits for jetting a fluid 167 face each other. Air knife portions 160*a* and 160*b* are the same as those of air knife assembly 10A of the first embodiment, and in reference to FIGS. 3 and 9, through holes 15*d* are provided so as to penetrate air knife unit portions 160*a* and 160*b* in the longitudinal direction, and long holes 15*e* which connect to these through holes 15*d* are provided on surfaces 160*c* and 160*d* of air knife unit portions 160*a* and 160*b*. In addition, covers 166 in L shape are provided on surfaces 160*c* and 160*d* of air knife unit portions 160*a* and 160*b*, respectively, in coupled air knife unit 160. A compressed fluid which has been supplied from connectors (not shown) which are provided to coupled air knife unit 160 to through holes 15*d* of air knife portions 160*a* and 160*b* passes through long holes 15*e*, flows along surfaces 160*c* and 160*d* of air knife unit portions 160*a* and 160*b*, respectively, in coupled air knife unit 160, and is blown out from slits for jetting a fluid 167.

As described above, the number of parts and the number of steps in assembly can be reduced in apparatus for drying a substrate 150 (or apparatuses for removing deposit from a substrate) of the present invention, where portion for processing a substrate 2 shown in FIG. 8 is formed using coupled air knife unit 160.

Fourth Embodiment

Though in the first to third embodiments, a fluid that has been led out from the main surface of substrate 90 via fluid lead-out path 60 spreads naturally, the fourth embodiment shows an example where a replenishing means for replenishing fluid that has been led out from the main surface of substrate 90 via fluid lead-out path 60 is provided, so that the fluid is forcefully discharged to the outside.

Figure 10:
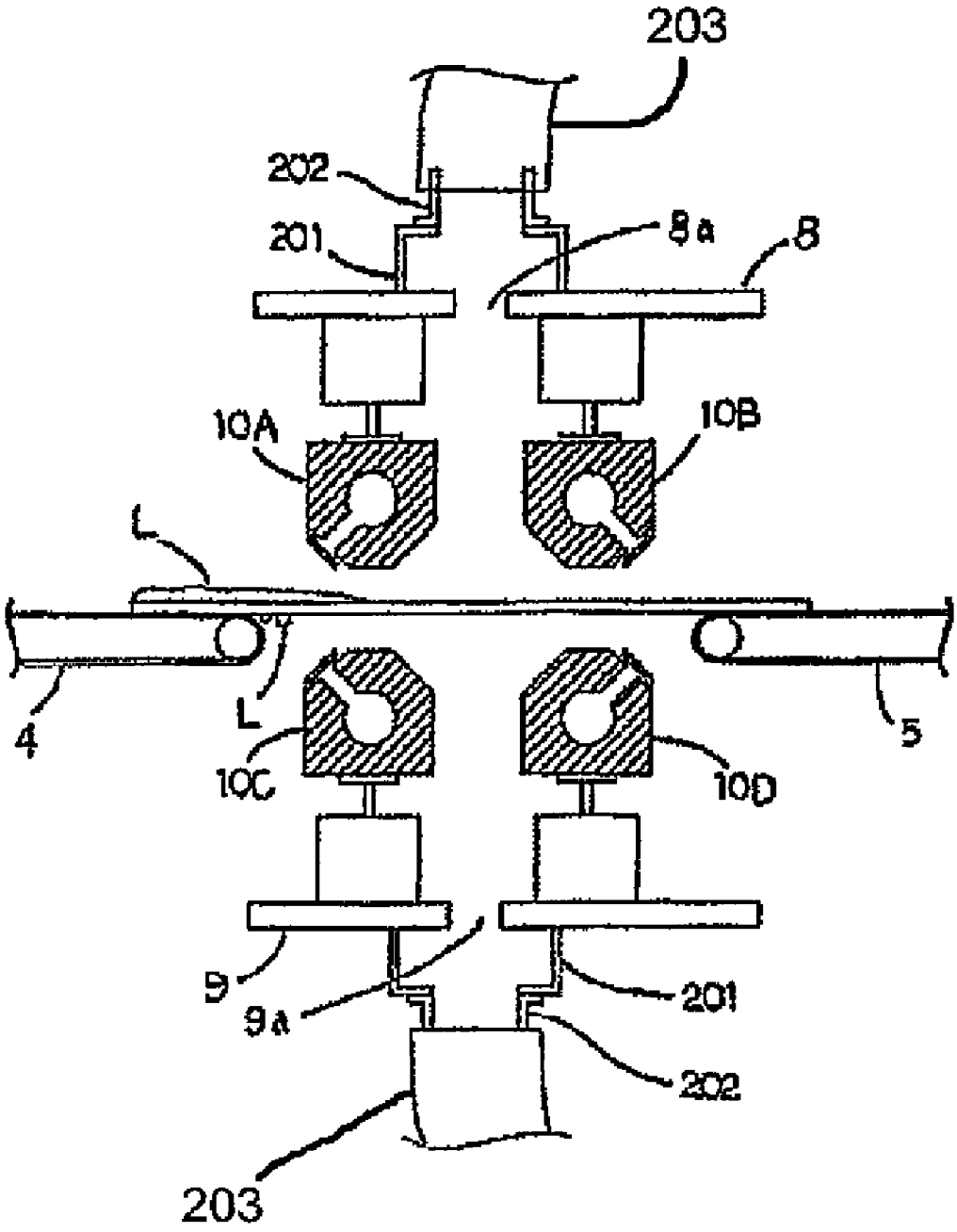
FIG. 10 is a cross sectional diagram showing an apparatus for processing a substrate according to the fourth embodiment of the present invention.

FIG. 10 is a schematic diagram showing the configuration of an apparatus for drying a substrate according to the fourth embodiment of the present invention.

An apparatus for drying a substrate 200 is gained by providing discharge openings 8*a* and 9*a*, which are long holes, to upper attachment base 8 and lower attachment base 9, respectively, in portion for processing a substrate 2 of any of apparatuses for drying a substrate 1, 100 and 150 according to the first to third embodiments, installing suction covers 201 so as to cover these respective discharge openings 8*a* and 9*a*, and respectively providing flanges 202 for connecting a pipe that is connected to a discharge duct (suction means) which is sucked by a suction motor (not shown) to these suction covers 201.

In apparatus for drying a substrate 200 according to the present fourth embodiment, dry air with which mist is mixed can be powerfully and efficiently discharged upward and downward from the front and rear surface of substrate 90 along fluid lead-out path 60 which is formed between the air knife units to the outside of apparatus for drying a substrate 200.

In addition, a discharge duct 203 for sucking a fluid by means of a suction motor is connected to fluid lead-out path 60, and a fluid in fluid lead-out path 60 which has been led out from the front and rear surface of substrate 90 is forcefully captured, and therefore, deposit that has been removed from the front and rear surface of substrate 90 can be prevented from attaching to the substrate again.

Though a typical form for the air knife units (or air knife unit portions) according to the first to fourth embodiments is hexagonal, so that dry air easily rises or descends along the form of the air knife, the form is not limited to being hexagonal, as long as it has surface 15*f* parallel to the substrate and allows a compressed fluid to easily rise and descend, and the form may be a curve or something other than hexagonal.

Fifth Embodiment

Though the first to fourth embodiments show examples where a fluid that is discharged from the slit portion of one air knife unit (or air knife unit portion, air knife assembly) has the appearance of a wall surface, a fluid that is discharged from the slit portion of another air knife unit (or air knife unit portion, air knife assembly) collides with the above described wall face, and furthermore, the above described fluid is led away from the main surface of the substrate via the above described fluid lead-out path, the fifth embodiment shows an example where the rear portion of one air knife unit (or air knife unit portion, air knife assembly) is used as a wall surface and a fluid that is discharged from the slit portion of another air knife unit (or air knife unit portion, air knife assembly) is led to the above described wall surface, and furthermore, the above described fluid is led away from the main surface of the substrate via the above described fluid lead-out path.

Figure 11:
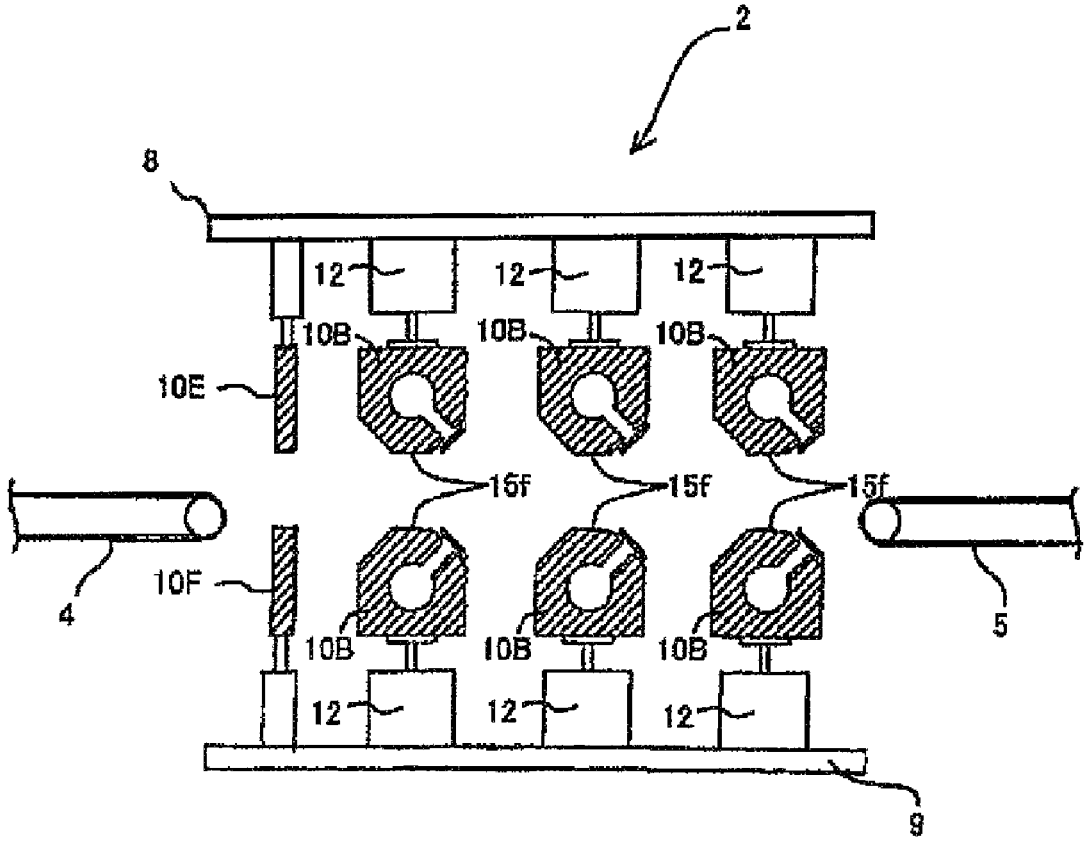
FIG. 11 is a cross sectional diagram showing an apparatus for processing a substrate according to the fifth embodiment of the present invention.
Figure 12:
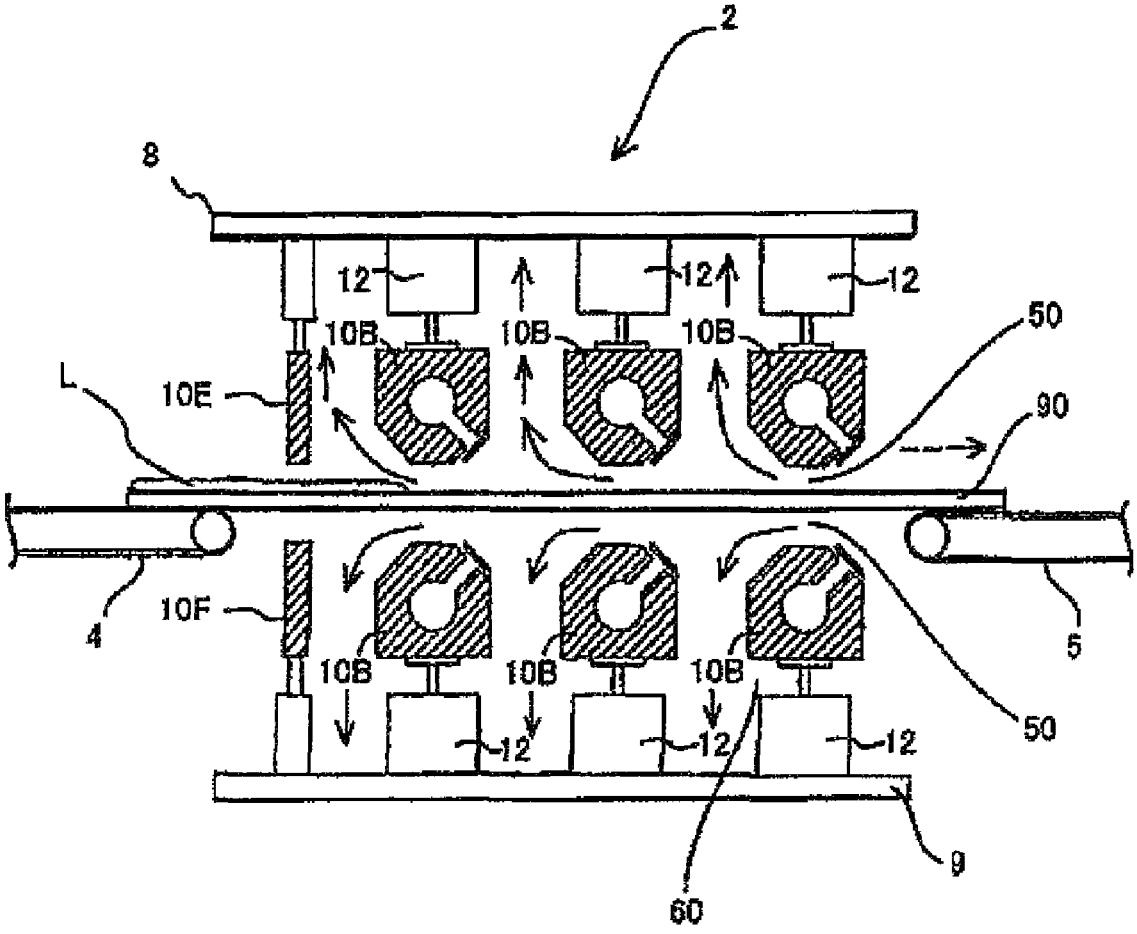
FIG. 12 is a diagram showing the state when the front and rear surface of a substrate is being processed in the fifth embodiment of the present invention.
Figure 13:
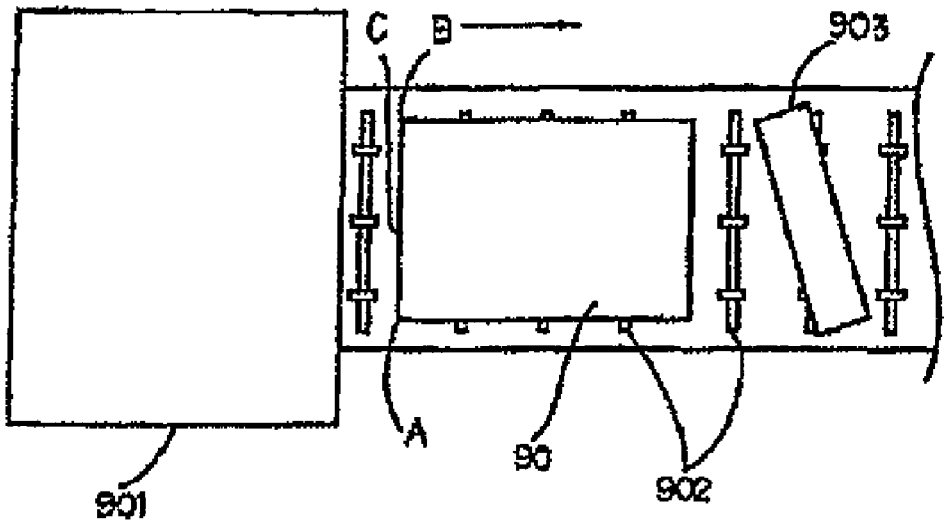
FIG. 13 is a plan diagram showing the apparatus for processing a substrate which is disclosed in Patent Document 1.
Figure 14:
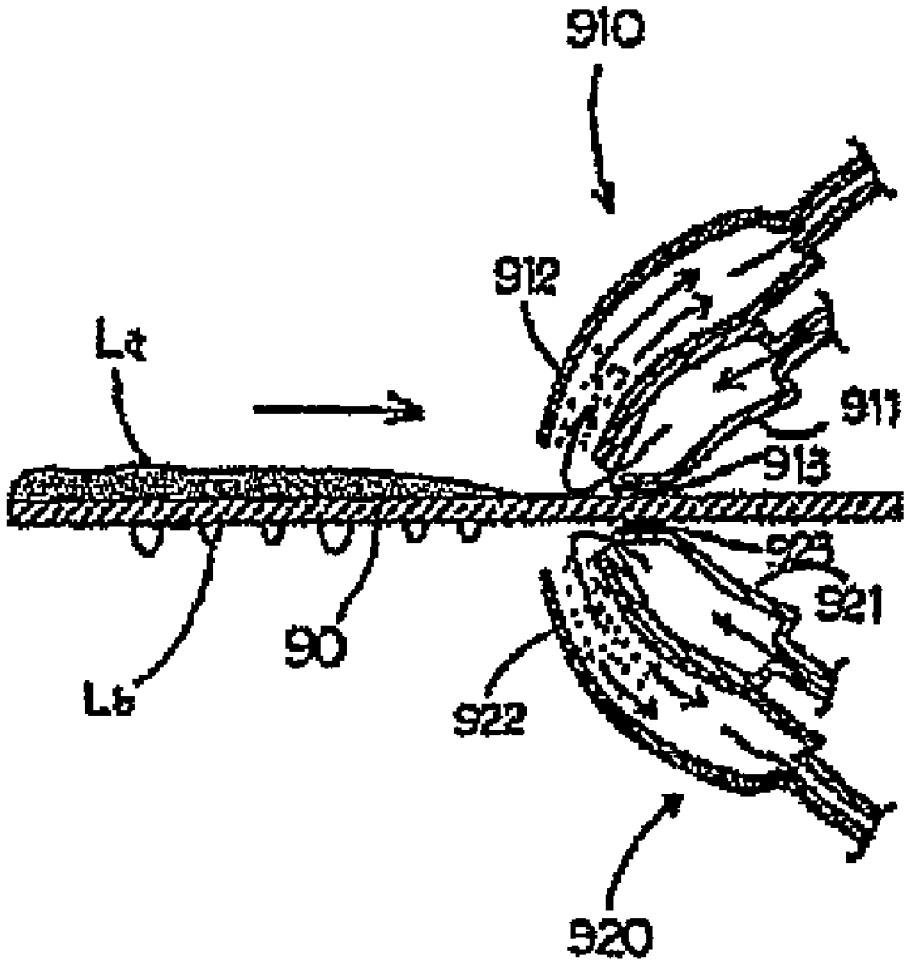
FIG. 14 is a cross sectional diagram showing the air knives for drying the front and rear surface of a substrate which are disclosed in Patent Document 2.

FIGS. 11 and 12 are cross sectional diagrams showing an apparatus for drying a substrate 300 according to the fifth embodiment of the present invention.

As shown in FIG. 11, a number of air knife assemblies 10B and 10D are placed in apparatus for drying a substrate 300, in such a manner that slits for jetting a fluid 17 of the respective air knife units face the same direction and slits for jetting a fluid 17 face the direction in which substrate 90 is conveyed.

In portion for processing a substrate 2, substrate 90 is conveyed from the left in the figure (the direction of conveyance is indicated by the arrow in the figure), and wall surfaces 10E and 10F, which are the first to face an end of substrate 90 at this time, as well as three air knife assemblies 10B and three air knife assemblies 10E, are sequentially positioned.

Wall surfaces 10A and 10F, three air knife assemblies 10B and three air knife assemblies 10D are provided on bases 8 and 9. The height of wall surfaces 10E and 10F can be separately adjusted by adjusting the screw portions, not shown, which are attached to bases 8 and 9.

The operation of apparatus for drying a substrate 300 according to the present fifth embodiment is described below.

As shown in FIG. 12, when substrate 90 is conveyed to portion for processing a substrate 2 by upstream conveyor 4 in the direction of the arrow in the figure, an appropriate flow amount of dry air is discharged from slits for jetting a fluid 17 of the respective air knife units of air knife assemblies 10B and 10D. In addition, at the point when substrate 90 passes by laminar flow creating surfaces 15*f* of respective air knife assemblies 10B and 10D, dry air flows through fluid introduction path 50 between substrate 90 and each of laminar flow creating surfaces 15*f*. As a result, negative pressure is created in the vicinity of the front and rear surface of substrate 90 in accordance with the flow amount of dry air, and air knife assemblies 10B and 10D approach or move away from the front and rear surface of substrate 90 so that a clearance of approximately 20 μm to 100 μm is maintained.

The surface of the rear portion of air knife assemblies 10B and wall surface 10E works as a wall surface with which air that has been discharged from respective slits 17 of adjacent air knife assemblies 10B and 10D collides (solid walls).

Dry air that has been discharged from air knife assemblies 10B and 10D passes through fluid introduction paths 50 of which the cross sectional area of the path is extremely small between the substrate and laminar flow creating surfaces 15*f* of air knife units 15 of air knife assemblies 10B and 10D, and subsequently, the flow of dry air that has been led by the above described wall surfaces is changed in direction by these wall surfaces, and furthermore, the liquid that has attached to substrate 90 is led away from the main surface of substrate 90, together with the above described dry air, via fluid lead-out path 60 of which the cross sectional area of the flow path is greater than that of fluid introduction path 50, and which is formed between air knife assemblies 10B and 10D and the above described wall surfaces.

In the fifth embodiment, it is preferable for the fluid in the fluid lead-out path which has been led out from the front and rear surface of substrate 90 to be forcefully captured using a capturing means as that shown in the fourth embodiment. As a result, the deposit that has been removed from the front and rear surface of substrate 90 can be prevented from attaching to the substrate again.

In addition, the air knife units (or air knife unit portions, air knife assemblies) of apparatuses for drying a substrate 1, 100, 150, 200 and 300 can be used as an apparatus for cleaning a substrate or the like with a liquid using a liquid such as water or a cleaning liquid as the fluid which is supplied from respective slits 17.

Here, though the above described embodiments show a configuration where air knife units (or air knife unit portions, air knife assemblies) are placed above and/or below a main surface of a substrate of which the main surface extends in a horizontal direction, the invention is not limited to these embodiments, and a configuration where air knife units are placed on one or both sides (that is to say, left and/or right side) of a main surface of a substrate of which the main surface extends in the vertical direction, for example, may be provided.

Though in all of the above described embodiments, an apparatus for drying a substrate is described, the apparatus also substantially functions as an apparatus for removing deposit from a substrate. That is to say, a fluid blows off deposit that has attached to a surface of a substrate, and thereby, the apparatus works as an apparatus for removing deposit from a substrate.

INDUSTRIAL APPLICABILITY

The present invention can be used in apparatuses for removing deposit from a substrate where deposit that has attached to a surface of a substrate is removed, particularly, apparatuses for drying a substrate where a substrate is dried by removing a fluid that has attached to a surface of a substrate.

The invention claimed is:

1. A method for removing deposit from a substrate comprising:

removing deposit that has attached to a main surface of a substrate from the main surface of the substrate using a number of air knife assemblies in which a slit portion is formed at the rear of the bottom surface so that a fluid can be discharged in band form when each air knife assembly is positioned so that the bottom surface thereof faces the main surface of a substrate and is moved relative to the substrate while a fluid is discharged from the slit portion;

forming a fluid introduction path having such a clearance as to make it possible for the fluid discharged from the slit portion to pass through in a condensed state between the main surface of the substrate and the bottom surface of each of the air knife assemblies so as to have an approximately uniform form in the direction perpendicular to the direction in which the air knife assemblies move;

discharging a fluid from the slit portion so that the fluid passes through the fluid introduction path in a condensed state, and then the condensed fluid that passes through the fluid introduction path is led to a wall surface that is formed so as to face the front portion of the air knife assemblies or is led to collide with the fluid from an adjacent air knife assembly that operates as a wall surface, and;

leading the deposit that has deposited on the substrate away from the main surface of the substrate, together with the fluid, via a fluid lead-out path which is formed between each air knife assembly and the wall surface or fluid from the adjacent air knife so that the cross section of the flow path is greater than that of the fluid introduction path, and allows the condensed fluid discharged from the fluid introduction path to disperse.

2. The method for removing deposit from a substrate according to claim 1, wherein the clearance between the air knife units and the main surface of the substrate is adjusted using the Venturi effect between the air knife units and the main surface of the substrate when the fluid passes through the fluid lead-out path, and thereby, the air knife units are supported relative to the main surface of the substrate in such a manner as to fluctuate.

3. The method for removing deposit from a substrate according to claim 1, wherein the air knife units are paired in the configuration, and in each pair, a fluid that is discharged from the slit portion of one air knife unit operates as a wall surface and a fluid that is discharged from the slit portion of the other air knife is made to collide with said wall surface, and furthermore, said fluid is led away from the main surface of the substrate via said fluid lead-out path.

4. The method for removing deposit from a substrate according to claim 1, wherein the air knife units are aligned parallel to each other, the rear portion of one air knife unit in each adjacent pair of air knife units is used as a wall surface, and a fluid that is discharged from the slit portion of the other air knife unit is led to said wall surface, and furthermore, said fluid is led away from the main surface of the substrate via said fluid lead-out path.

5. The method for removing deposit from a substrate according to claim 1, wherein at least two air knife units of a pair are respectively provided on the two main surfaces, front and rear, of the substrate.

6. The method for removing deposit from a substrate according to claim 1, wherein the fluid that is discharged from the slit portions is a combination of a gas for drying a substrate and a liquid for cleaning a substrate.

7. A method for drying a substrate, for removing a liquid that has attached to a main surface of a substrate from the main surface of the substrate using air knife units in which a slit portion is formed, so that a dry gas can be discharged in band form, wherein a fluid introduction path having an approximately uniform form in the direction perpendicular to the direction in which a number of air knife units move is formed between the air knife units and the main surface of the substrate while the air knife units move relative to the substrate, and a dry gas is discharged toward the fluid introduction path from slit portions which are formed in the rear portion of said air knife units, next, the dry gas passes through the fluid introduction path and is led to a wall surface that is formed in such a manner as to face the front portion of the air knife units, said wall surface is formed of a dry gas that is discharged from the slit portion of one air knife unit and a dry gas that is discharged from the slit portion of another air knife unit is led to said wall surface, and furthermore, a liquid that has attached to the substrate is led away from the main surface of the substrate, together with said dry gas, via a fluid lead-out path of which the cross sectional area of the flow path is greater than that of the fluid introduction path and which is formed between the air knife units and the wall surface.

8. A method for removing deposit from a substrate comprising:

removing deposit that has attached to a main surface of a substrate from the main surface of the substrate using air knife units in which a slit portion is formed so that a fluid can be discharged in band form;

forming a fluid introduction path having an approximately uniform form in the direction perpendicular to the direction in which a number of air knife units move relative to a substrate, so that the fluid introduction path is between the air knife units and the main surface of the substrate while the air knife units move relative to the substrate;

discharging a fluid toward the fluid introduction path from a slit portion that is formed in the rear portion of said air knife units, and then, the fluid passes through the fluid introduction path so as to be led to a wall surface that is formed so as to face the front portion of the air knife units or fluid from an adjacent air knife which operates as a wall surface; and leading away deposit that has deposited on the substrate from the main surface of the substrate, together with said fluid, via a fluid lead-out path which is formed between the air knife units and the wall surface so that the cross section of the flow path is greater than that of the fluid introduction path;

wherein the clearance between the air knife units and the main surface of the substrate is adjusted using the Venturi effect between the air knife units and the main surface of the substrate when the fluid passes through the fluid lead-out path, and thereby, the air knife units are supported relative to the main surface of the substrate in such a manner as to fluctuate.

9. The method for removing deposit from a substrate according to claim 8, wherein the air knife units are paired in the configuration, and in each pair, a fluid that is discharged from the slit portion of one air knife unit operates as a wall surface and a fluid that is discharged from the slit portion of the other air knife is made to collide with said wall surface, and furthermore, said fluid is led away from the main surface of the substrate via said fluid lead-out path.

10. The method for removing deposit from a substrate according to claim 8, wherein the air knife units are aligned parallel to each other, the rear portion of one air knife unit in each adjacent pair of air knife units is used as a wall surface, and a fluid that is discharged from the slit portion of the other air knife unit is led to said wall surface, and furthermore, said fluid is led away from the main surface of the substrate via said fluid lead-out path.

11. The method for removing deposit from a substrate according to claim 8, wherein at least two air knife units of a pair are respectively provided on the two main surfaces, front and rear, of the substrate.

12. The method for removing deposit from a substrate according to claim 8, wherein the fluid that is discharged from the slit portions is a combination of a gas for drying a substrate and a liquid for cleaning a substrate.

* * * * *